US006293663B1

(12) United States Patent
Koshikawa et al.

(10) Patent No.: US 6,293,663 B1
(45) Date of Patent: Sep. 25, 2001

(54) INK TANK

(75) Inventors: Hiroshi Koshikawa, Kawasaki; Osamu Morita, Yokosuka; Kenji Kitabatake, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,008

(22) Filed: Oct. 25, 1999

(30) Foreign Application Priority Data

Oct. 27, 1998 (JP) ..... 10-306147

(51) Int. Cl.[7] ..... B41J 2/175
(52) U.S. Cl. ..... 347/86
(58) Field of Search ..... 347/84, 85, 86, 347/87, 89; 400/124.1

(56) References Cited

U.S. PATENT DOCUMENTS

| | | | | |
|---|---|---|---|---|
| 4,481,163 | | 11/1984 | Ota et al. | 264/513 |
| 5,182,581 | * | 1/1993 | Kashimura et al. | 347/86 |
| 5,760,805 | * | 6/1998 | Binnert et al. | 347/86 |
| 5,815,184 | * | 9/1998 | Ujita et al. | 347/89 |

FOREIGN PATENT DOCUMENTS

| | | |
|---|---|---|
| 829363 | 3/1998 | (EP) . |
| 906830 | 4/1999 | (EP) . |

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

An ink tank having a negative pressure generating member for retaining ink, a case for accommodating the negative pressure generating member, the case having an atmosphere communicating portion held in communication with the atmosphere and an ink supply portion through which the ink is led out to the exterior, and an ink holding member disposed near the ink supply portion and developing a higher capillary action than the negative pressure generating member, wherein a recess is formed in an inner surface of a side wall of the case adjacent to a wall provided with the ink supply portion, the recess extending in a direction from the side of a wall opposing the wall provided with the ink supply portion toward the ink supply portion. Alternatively, in an ink tank having no ink holding member, at least a part of inner surfaces of the case is subjected to pear-skin treatment. With those ink tanks, a satisfactory ink supply ability is obtained while achieving a reduction of the tank size.

5 Claims, 7 Drawing Sheets

INK TANK

BACKGROUND OF THE INVENTION

1. Field of the Invention

The present invention relates to an ink tank for retaining ink supplied to an ink jet recording head, and more particularly to an ink tank having an ink containing portion in which a negative pressure generating member, e.g., an ink absorber, for retaining ink, is contained.

2. Description of the Related Art

Hitherto, recording apparatuses for recording an image on recording media such as paper, cloth, plastic sheets and OHP sheets (referred to simply as "recording paper" hereinafter) have been proposed in the forms capable of mounting recording heads of various recording schemes such as wire dot, heat sensitive, heat transfer, and ink jet schemes.

Of those recording apparatuses, an ink jet recording apparatus has been employed and commercialized as output means of information processing systems, e.g., printers serving as output terminals of copying machines, facsimiles, electronic type writers, word processors and work stations, and handy or portable printers associated with personal computers, host computers, optical disk devices, video devices, etc.

Particularly, with recent popularity of the Internet and digital cameras, color ink jet recording apparatuses are becoming pervasive as means for outputting color images provided from the Internet and digital cameras.

In a color-adapted ink jet recording apparatus, a color image is formed by superimposing ink droplets in multiple colors ejected from recording heads. Color recording generally requires inks of three primary colors, i.e., yellow (Y), magenta (M) and cyan (C), or inks of four colors including black (B) in addition to the three primary colors, as well as three or four units of recording heads and ink cartridges corresponding to the inks.

Further, for the purpose of improving halftone representation of ink jet printers, it has become general to employ inks of six or seven colors including inks with light density (i.e., light yellow, light magenta and light cyan) in addition to the above inks of three or four colors.

Meanwhile, as an energy element for generating energy to eject ink through an ejection orifice of a recording head, there is known, e.g., a piezoelectric element using an electrical displacement transducer, an element for irradiating an electromagnetic wave, such as a laser beam, to generate heat and ejecting ink droplets under an action of the generated heat, or an element for heating a liquid with an electrothermal transducer having a heat generating resistor.

In such an ink jet recording head, the printing speed has been increased by employing the multi-nozzle scheme and increasing the ejection frequency.

Also, an ink tank for supplying ink to the ink jet recording head is detachably attached to a recording apparatus in integral form with the recording head in many cases for the purpose of downsizing. Such a cartridge type ink tank integral with a recording head (including an structure in which the ink tank is always integral with the recording head and an structure in which the ink tank is separable from the recording head) is required to generate a predetermined negative pressure relative to the recording head. One method of generating a predetermined negative pressure is realized by inserting, in the ink tank, an ink absorber which is then impregnated with ink. The ink absorber is formed of a porous member such as a urethane foam, or a felt using fibers of a thermoplastic resin such as polypropylene.

The use of the above-mentioned multi-color system in six or seven colors naturally increases the kinds of inks used. In particular, when ink tanks containing inks of respective colors are constructed in the separate form allowing the tanks to be replaced independently for each color, six or seven ink tanks have to be arranged side by side. Therefore, it is desired from a restriction in overall size that the width of each ink tank is as small as possible.

Moreover, employing the multi-nozzle scheme and increasing the ejection frequency to achieve a higher printing speed, as described above, increases a flow rate of the ink per unit time. Correspondingly, an ink supply flow rate required for the ink tank is also increased. This may cause such a risk in a tank having a narrow width that a sufficient sectional area of a flow passage is not secured and resistance of the flow passage against the ink flow is too increased to supply ink to the recording head reliably. In the recording head, a flow passage is enlarged corresponding to the increased ink flow rate, and the diameter of a joint portion of the recording head with the ink tank is also increased. This has resulted in a difficulty in mounting an ink tank having a narrow width to the joint portion. In an ink tank having a narrow width, an ink absorber inserted in the ink tank also has the form having a narrow width. Further, increasing the amount of ink contained in an ink tank renders the ink tank to have a flat thin shape. In such a case, walls of the ink tank are required to have a greater thickness relative to the tank width for securely providing sufficient strength of a tank housing (case). If so, the ink flow in a direction from the ink absorber toward an ink supply port is restricted, and hence insufficient supply of ink may occur depending on the condition in use. Another problem is that because the absorber has a narrow width, the ink may be left in contact areas between inner wall surfaces of the tank and the absorber.

On the other hand, focusing an attention to an ink absorber inserted in the ink tank, it is preferable for improving the efficiency in use of ink contained in the tank that the ink absorber be inserted in the ink tank under compression increasing gradually toward the ink supply port jointed to the recording head.

However, even if the absorber inserted in the ink tank can be given a satisfactory coarse/dense relation adjusted with good accuracy, such a state is difficult to maintain for a long period of time, and the satisfactory coarse/dense relation may be lost due to a restoring force caused by elasticity of the absorber itself and an impact applied externally in the event of a drop or the like. Further, for the similar reasons, it may occur somewhere that the absorber is not held in good close contact with the inner wall of the ink tank.

SUMMARY OF THE INVENTION

With the view of solving the problems set forth above, a first object of the present invention is to provide an ink tank, particularly a thin type ink tank, with which ink can be supplied in a stable manner and a less amount of ink is left in the tank.

A second object of the present invention, which is realized solely or in combination with the first object, is to provide an ink tank with which a coarse/dense relation suitable for ensuring satisfactory ink supply is maintained in an ink absorber.

To achieve the above first object, the present invention provides an ink tank comprising a negative pressure generating member for retaining ink, a case for accommodating the negative pressure generating member, the case having an atmosphere communicating portion held in communication with the atmosphere and an ink supply portion through which the ink is led out to the exterior, and an ink holding member disposed near the ink supply portion and developing a higher capillary action than the negative pressure generating member, wherein a recess is formed in an inner surface of a side wall of the case adjacent to a wall provided with the ink supply portion, the recess extending in a direction from the side of a wall opposing the wall provided with the ink supply portion toward the ink supply portion.

With the above features, a large diameter of the ink holding member can be secured relative to the tank case, and an ink tank having a narrow width and a satisfactory ink supply ability can be obtained.

To achieve the above second object, the present invention also provides an ink tank comprising a negative pressure generating member for retaining ink, and a case for accommodating the negative pressure generating member, the case having an atmosphere communicating portion held in communication with the atmosphere and an ink supply portion through which the ink is led out to the exterior, wherein at least a part of inner surfaces of the case is subjected to pear-skin treatment.

With the above features, by applying the pear-skin treatment to the inner surface of the tank case, the negative pressure generating member accommodated in the ink tank is prevented from displacing relative to the inner surface. Therefore, after inserting the negative pressure generating member in the ink tank while it is given a coarse/dense distribution suitable for stable ink supply, the coarse/dense distribution given to the negative pressure generating member can be kept with stability.

DESCRIPTION OF THE DRAWINGS

FIGS. 1A to 1C show a construction of an ink tank case according to a first embodiment of the present invention, in which FIG. 1A is a front view, FIG. 1B is a side view, and FIG. 1C is a plan view;

FIGS. 3A and 3B show a pressure contact member fitted to a supply port of the ink tank shown in FIG. 1, in which FIG. 3A is a front view and FIG. 3B is a plan view;

FIGS. 6A and 6B show a construction of a holder unit for accommodating the ink tank unit, in which FIG. 6A is a front view and FIG. 6B is a plan view;

DESCRIPTION OF THE PREFERRED EMBODIMENTS

Preferred embodiments of the present invention will be described with reference to the drawings.

In the following description, the so-called ink containing a color material is employed, by way of example, as a liquid contained in an ink tank. However, the liquid contained in the ink tank according to the present invention is not limited to the ink, but may include any kinds of liquids so long as they can be ejected from a recording head. Concretely, the liquid includes such a treatment liquid as reacting with another liquid (or ink) on the surface of a recording medium such as a sheet of recording paper or during ejection of the liquid, to thereby improve water insolubility of the applied liquid on the recording medium. In this specification, therefore, the term "ink" is employed as meaning all kinds of liquids which can be ejected from a recording head.

(First Embodiment)

Figure 1C:
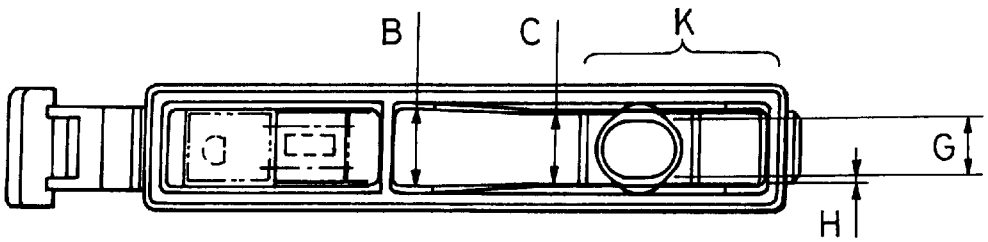
Figure 1A:
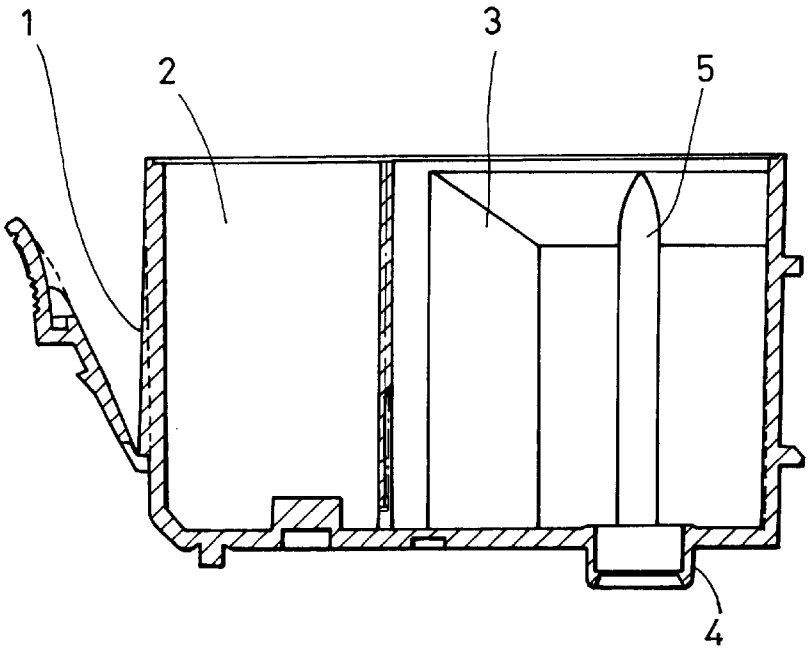
Figure 1B:
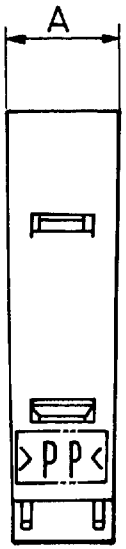
Figure 2:
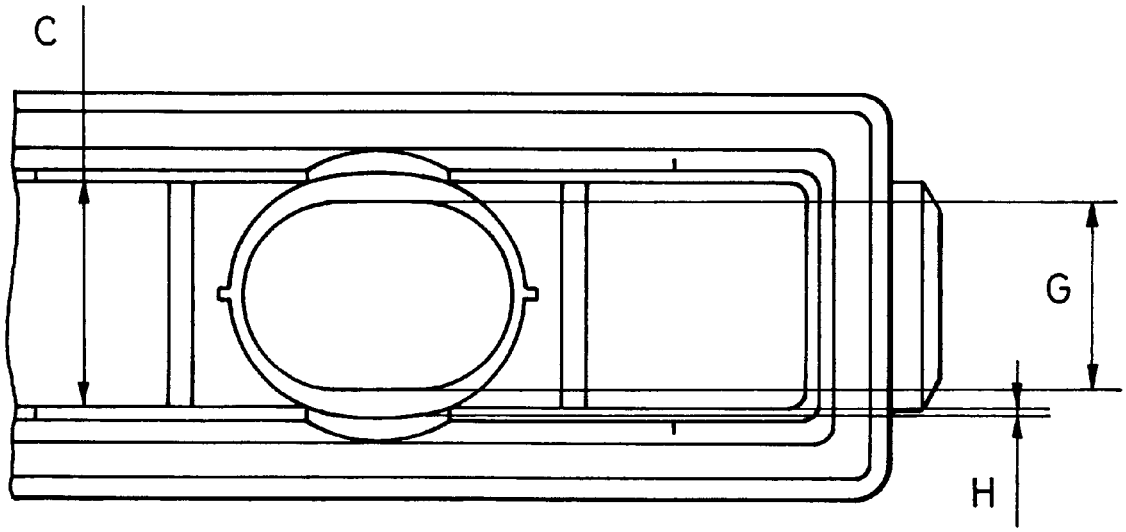
FIG. 2 is an enlarged view of a portion K in FIG. 1.

FIGS. 1A to 1C show a construction of an ink tank case according to a first embodiment of the present invention, in which FIG. 1A is a front view, FIG. 1B is a side view, and FIG. 1C is a plan view, and FIG. 2 is an enlarged view of a portion K in FIG. 1.

An ink tank case 1 in this embodiment is disposed on a printer body side by side in number six at maximum. The ink tank case 1 has a width A not greater than 12.5 mm in body design to achieve a reduction in printer size. In consideration of a wall thickness and a taper necessary for removal of the case in its molding process as well, as shown in FIG. 1C, the ink tank case 1 has an inner-wall to inner-wall width B of 7.7 mm in a relatively wide portion, and an inner-wall to inner-wall width C of 6.89 mm in a portion near an ink supply port where a tank wall is relatively thick.

One of the reasons why the tank wall is gradually thickened toward the supply port is to increase the density of an ink absorber toward the supply port and to stabilize the supply of ink. Another reason is to give both sides of the ink tank a sufficient rigidity so that the ink is avoided from leaking through the supply port even when the user grasps the sides of the ink tank by a strong force, and that the ink tank is prevented from expanding to such an extent as to causing a functional problem, for example, even if the tank is left under high temperatures.

Numeral 2 denotes an ink containing chamber in which recording ink is directly contained, and 3 denotes an absorber accommodating chamber in which an ink absorber 7 is accommodated. The ink absorber 7 is impregnated with the ink and retains the ink therein. Numeral 4 denotes an ink supply port provided in one wall of the absorber accommodating chamber 3 for supplying the ink to a recording head through the port. A pressure contact member 6 having a substantially columnar shape is fitted to the supply port 4.

Figure 3B:
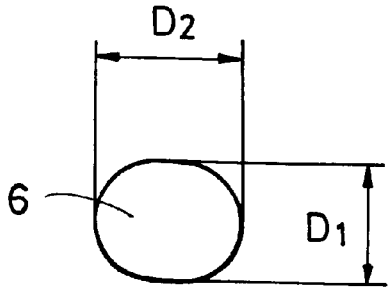
Figure 3A:
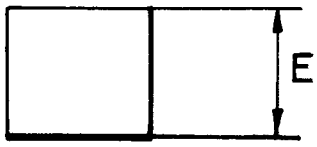

FIGS. 3A and 3B show the pressure contact member serving as an ink holding member, in which FIG. 3A is a front view and FIG. 3B is a plan view. The pressure contact member 6 is formed of polypropylene felt, for example. Specifically, the pressure contact member 6 has a superior ink holding ability to the ink absorber 7 and a sufficient density not to easily deform even under external forces, etc., so that it can suitably serve as a joint member with the recording head. Because the pressure contact member 6 has a greater density than the absorber and hence develops greater flow resistance than the absorber, a sectional area of the pressure contact member 6 is preferably given by a width D1 (7.3 mm) and a length D2 (8.7 mm), as shown in FIG. 3, for providing a satisfactory ink supply ability at a desired ink flow rate. Additionally, the pressure contact member 6 in this embodiment has a height E of 7.0 mm.

Figure 4:
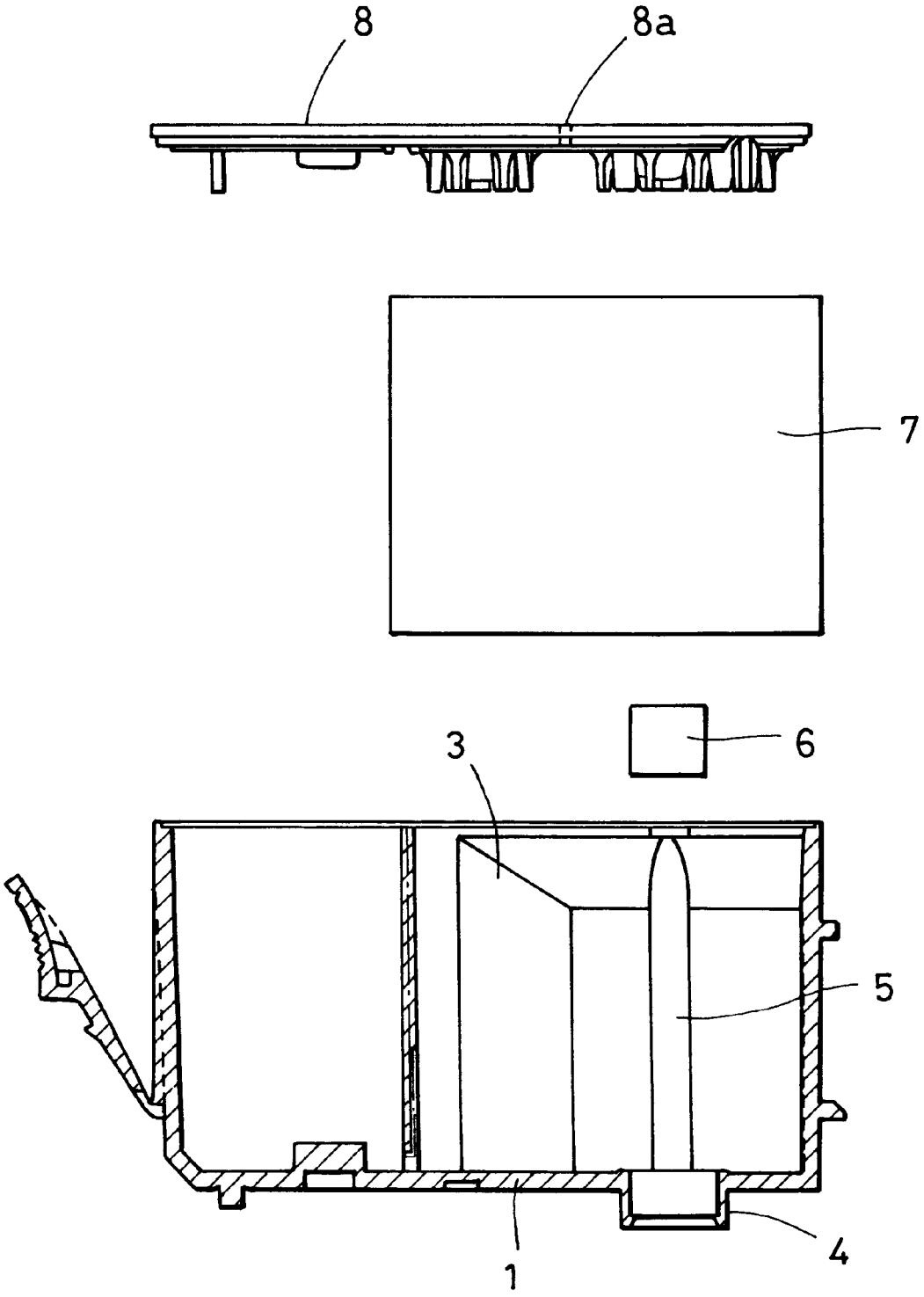
FIG. 4 is an exploded view showing a manner of assembling the ink tank shown in FIG. 1.
Figure 5:
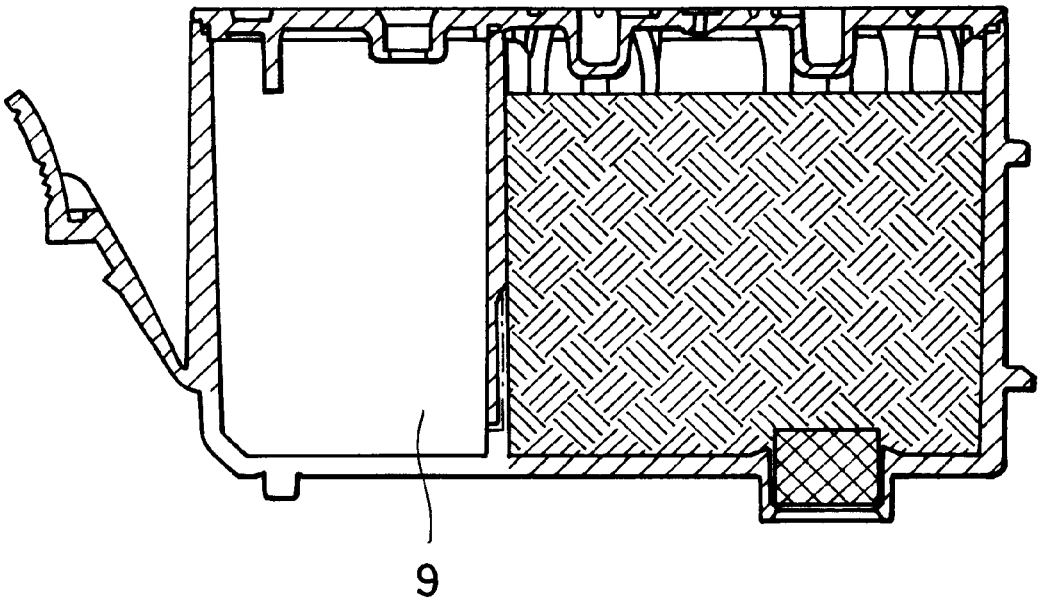
FIG. 5 is a sectional view of an ink tank unit assembled in accordance with the assembling manner shown in FIG. 4.

FIG. 4 shows a manner of assembling the ink tank, and FIG. 5 shows an ink tank unit after being assembled. As shown in FIG. 4, the pressure contact member 6 is first inserted in the ink tank case 1, and the absorber 7 serving as an ink retaining member is then inserted in the ink tank case 1. Finally, an ink tank cover 8 having an atmosphere communicating hole 8*a* formed therein is joined to the ink tank case 1 by ultrasonic welding or any other suitable means. An ink tank unit 9 shown in FIG. 5 is thus completed.

Figure 6B:
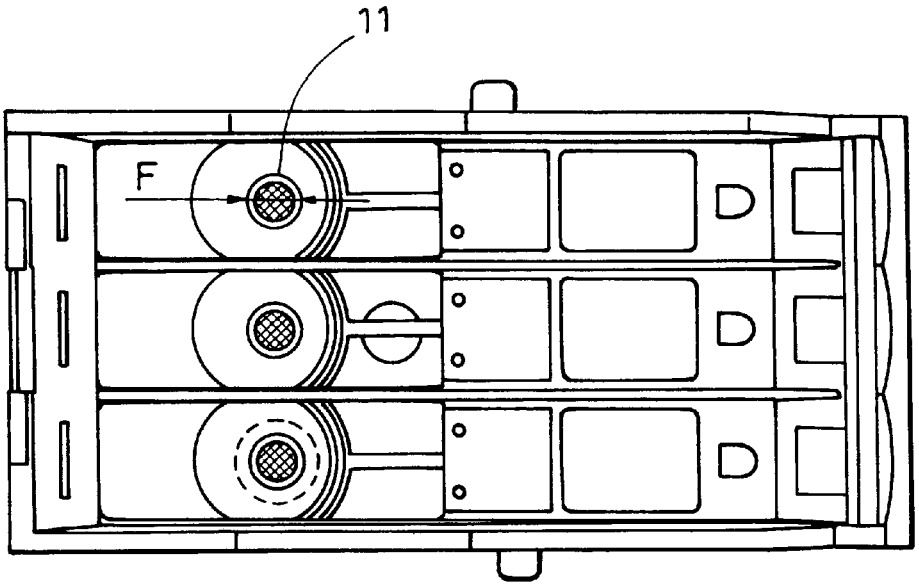
Figure 6A:
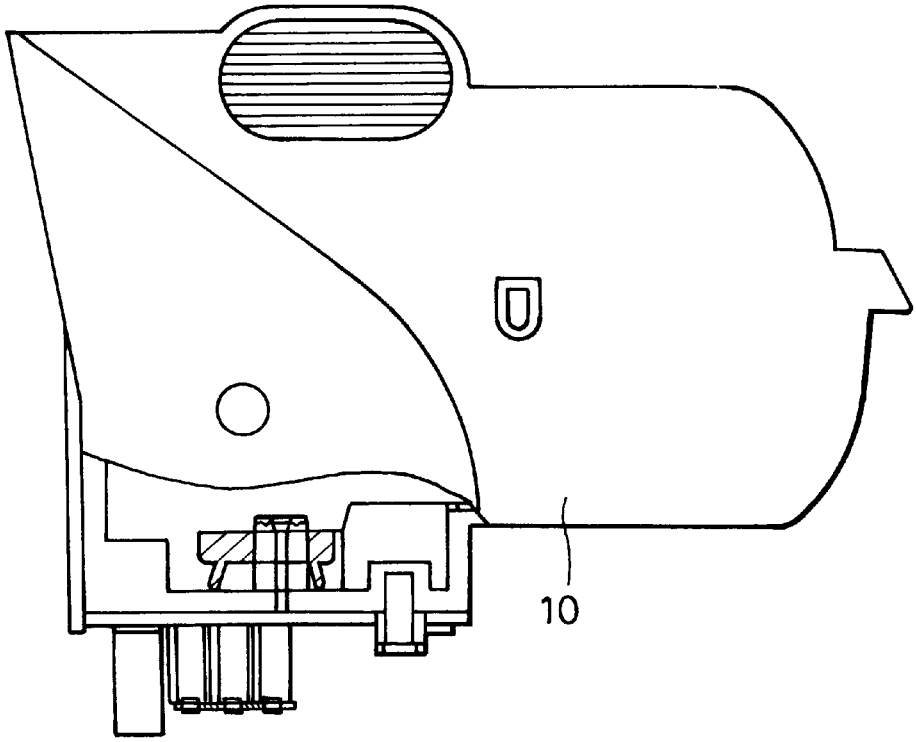

FIGS. 6A and 6B show a construction of a holder unit 10 including a recording head and accommodating the ink tank unit 9, in which FIG. 6A is a front view and FIG. 6B is a plan view. Referring to FIGS. 6A and 6B, numeral 11 denotes a joint portion which includes a filter for ink filtration and comes into abutment with the pressure contact member 6 in the supply port 4 to define a flow passage communicating with the ink tank. The joint portion 11 has a diameter F that is set to an allowable minimum size within such a range as not generating excessive flow-passage resistance for the ink flow rate required when the recording head is operating at a full load. An optimum value of the diameter F is appropriately determined depending on design of the recording head, the absorber inserted in the ink tank, the filter, etc. In this embodiment, the diameter F is set to 5.4 mm. On the other hand, the width G of an opening of the supply port 4 shown in FIG. 1C is 5.8 mm that is an allowable minimum value in consideration of tolerance in mounting. The width D1 of the pressure contact member 6 shown in FIG. 3 is preferably not less than 7.3 mm in consideration of both the width G of the opening of the supply port 4 and the size of a flange provided around the opening of the supply port 4 for supporting the pressure contact member 6.

In order that the pressure contact member 6 having the width D1 of 7.3 mm can be inserted into the supply port 4 from above the ink tank case 1 through an inner space of the tank having the inner-wall to inner-wall width C of 6.89 mm, a pressure contact member inserting groove (recess) 5 is formed as shown FIG. 1A. The pressure contact member inserting groove 5 has a depression H of 0.3 mm at maximum, allowing the pressure contact member 6 to be introduced to the supply port 4 out of interference with the inner walls of the tank. The pressure contact member inserting groove 5 is filled with a part of the absorber 7 under a reaction force of itself. After leaving the ink tank unit at high temperatures for test, it has been proved that no air passes through the pressure contact member inserting grooves 5 even in the tank expanded to some extent, and the ink is supplied with stability.

Returning to FIG. 4, the absorber (negative pressure generating member) 7 and the pressure contact member (ink holding member) 6 are accommodated in the absorber accommodating chamber (negative pressure generating member accommodating chamber) 3. The pressure contact member 6 developing a higher capillary action than the absorber 7 is disposed in the supply port 4. In this embodiment, as shown in FIG. 4, the recess 5 is formed in an inner wall surface of the ink tank to extend from a top of the inner wall toward the supply port 4, and the absorber 7 is held in close contact with the recess 5. The recess 5 is formed in each of the opposing inner wall surfaces of the tank. With the recess 5 formed in the inner wall surface of the tank, the absorber 7 contacts the recess 5 along its outwardly curved surface, and a compression rate in a part of the absorber 7 contacting the recess 5 is relatively reduced as compared with that in the remaining part of the absorber 7. At a boundary area between the absorber 7 and the recess 5, therefore, resistance imposed on a flow of the ink 1*d* out of the tank through the recess 5 is lowered so that the ink tends to easily collect to the boundary area. Particularly, since the recess 5 is formed from a position above the supply port 4 toward the supply port 4, the ink can be positively collected to the supply port 4 and stable supply of the ink can be realized. Also, since the tank wall is thickened near the supply port 4, as described above, to increase the compression rate of the absorber 7 in that area, a supply failure of the ink is prevented. By forming the recess 5 in the area where the compression rate of the absorber 7 is high, as one preferable embodiment of the present invention, a portion having a low compression rate (i.e., a coarse area) can be partly created in the area having a high compression rate. Such a combination of the coarse and dense areas enables the ink to be supplied with stability.

The recess formed in the inner wall surface of the tank has a substantially arcuate shape corresponding to the pressure contact member 6 having a substantially columnar shape. Because of the recess having a gentle arcuate shape, the absorber contacts a gently curved surface of the recess without causing any undesired gap, and the coarse/dense distribution is avoided from varying locally.

The recess is not always required to extend from the top of the tank, but may be formed to extend from halfway the inner wall surface of the tank toward the supply port (the pressure contact member). Further, the width and number of the recesses can be appropriately determined depending on the shape and size of the ink tank, the shape and size of the pressure contact member, etc. so long as at least one recess is formed to extend in a direction toward the supply port. Additionally, the pressure contact member inserting groove (recess) 5 serves also to ensure stable supply of the ink.

In this embodiment, the diameter of the pressure contact member is greater than the distance between the opposing inner wall surfaces of the tank. Thus, the width of the ink tank is narrowed and the width of a printer can be reduced even when tanks corresponding to photo inks (e.g., inks of six colors) adapted for a photo image quality are arranged side by side. Also, since the relatively large diameter of the pressure contact member is ensured even with a reduction in the width of the tank, the ink can be supplied in a required amount. Further, by establishing the compression rate of the absorber as described above, stable supply of the ink can be achieved in the thin type ink tank according to this embodiment.

Moreover, in this embodiment, for the purpose of improving the efficiency in use of the ink, a coarse/-dense relation suitable for stable ink supply is given to the absorber such that the compression rate of the absorber inserted in the ink tank is gradually increased toward the supply port. In addition, to prevent the satisfactory coarse/dense relation once given to the absorber from being lost upon displacement of the absorber relative to the inner wall of the ink tank due to a restoring force caused by elasticity of the absorber itself and an impact applied externally in the event of a drop or the like, pear-skin treatment is applied to the inner wall of the ink tank, including the recess, so as to provide surface roughness of 0.1 $\mu$m to 0.5 $\mu$m in terms of center line mean roughness (Ra) (JIS B 0601). As a result, friction between the inner wall of the ink tank, including the recess, and the absorber serving as a negative pressure generating member and having a rough surface, such as a urethane foam, is increased. In this embodiment, the inner surface of the recess is also subjected to the pear-skin treatment so that the absorber held in close contact with the recess is prevented from displacing due to an impact applied externally in the event of a drop or the like, thereby avoiding the occurrence of a gap (space) between the absorber and the inner surface of the recess. Here, the pear-skin treatment may be applied to any part of the inner surfaces of the tank case, but is preferably applied to one of the inner surfaces which has a maximum surface area (i.e., the inner surface shown in FIG. 4). It is more desired that the inner surface opposing to the above one surface, i.e., the surface treated into a pear-like skin, is also subjected to the pear-skin treatment.

While the above embodiment has been described in connection with the ink tank comprising two chambers, i.e., the absorber accommodating chamber and the ink containing chamber, the present invention is not limited to the above embodiment, but can also be applied to a conventional ink tank of one-chamber structure in which an ink absorber is accommodated in almost all space of an ink tank. The ink absorber is preferably formed of a material resulted by treating a porous member, such as a urethane foam, under heat compression particularly when a coarse/dense distribution is given to the ink absorber. However, the ink absorber is not limited to the above material, but may be formed of synthetic fibers of a thermoplastic resin, such as polypropylene and polyethylene, which are bundled into a pad or processed into the form of felt.

(Second Embodiment)

While the above first embodiment is constructed to achieve both the first and second objects of the present invention, this second embodiment is constructed to achieve the second object of the present invention solely. The second embodiment will be described below with reference to FIGS. 7 and 8.

Figure 7A:
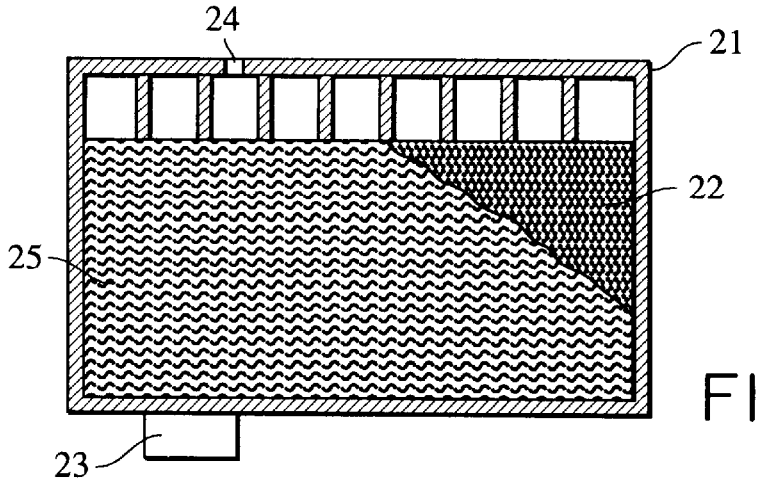
FIGS. 7A to 7C Care explanatory views of an ink tank according to a second embodiment of the present invention.
Figure 7B:
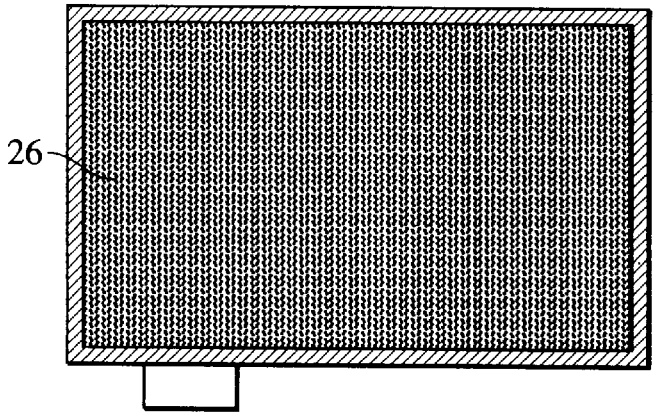
Figure 7C:
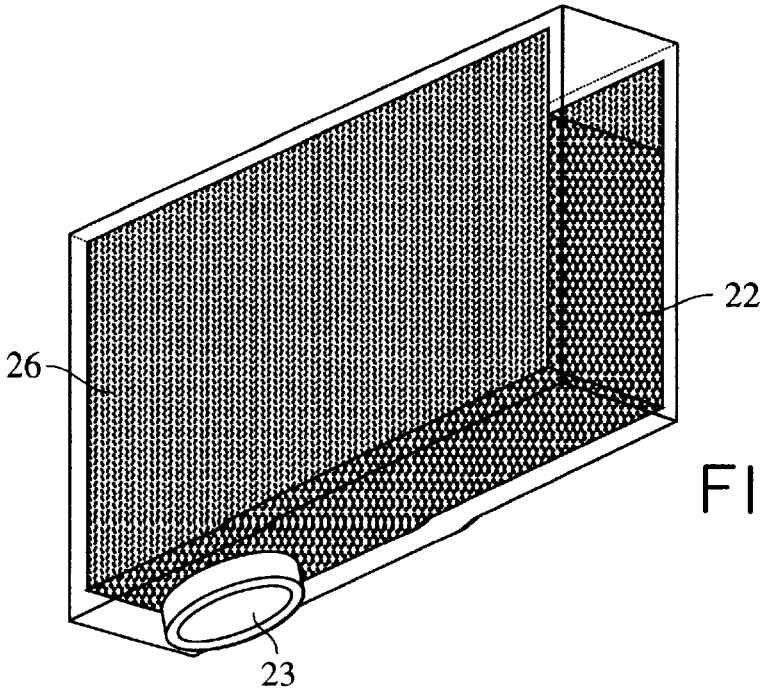

FIGS. 7A to 7C are explanatory views of an ink tank according to the second embodiment of the present invention, in which FIG. 7A is a vertical sectional view taken along a center line in the longitudinal direction, FIG. 7B is a side view showing an inner side surface in the longitudinal direction, and FIG. 7C is a perspective view of the ink tank viewed from a lower rear position.

In FIGS. 7A to 7C, numeral 21 denotes an ink tank assembly. Numeral 22 denotes an absorber, and 23 denotes an ink supply port with which a filter at the fore end of a supply tube extended from a recording head is contacted for supply of the ink to the recording head. Numeral 24 denotes an atmosphere communicating hole through which air is introduced, and 25 denotes an ink absorber which is impregnated with ink and serves as a negative pressure generating member. It is preferable, as described above, that the absorber 22 is formed of, a urethane foam as one example a porous member, or formed by using synthetic fibers of a thermoplastic resin, such as polypropylene, and then bundled the fibers into a pad or processing the fibers into the form of felt.

Of the steps of forming the ink tank assembly, the step of inserting the absorber in the ink tank is shown in FIGS. 8A to 8D. Numeral 101 denotes an ink absorber, and 103 denotes an ink tank molding provided with an ink supply port 102 in a lower portion thereof. Numerals 104 and 105 denote two pairs of first and second pressing members opposed to each other, respectively, and 106 denotes a third pressing member. Teflon sheets (not shown) are pasted on surfaces of the first and second pressing members 104, 105 for the purpose of reducing frictional resistance between the ink absorber 101 and both the pressing members 104, 105.

Figure 8A:
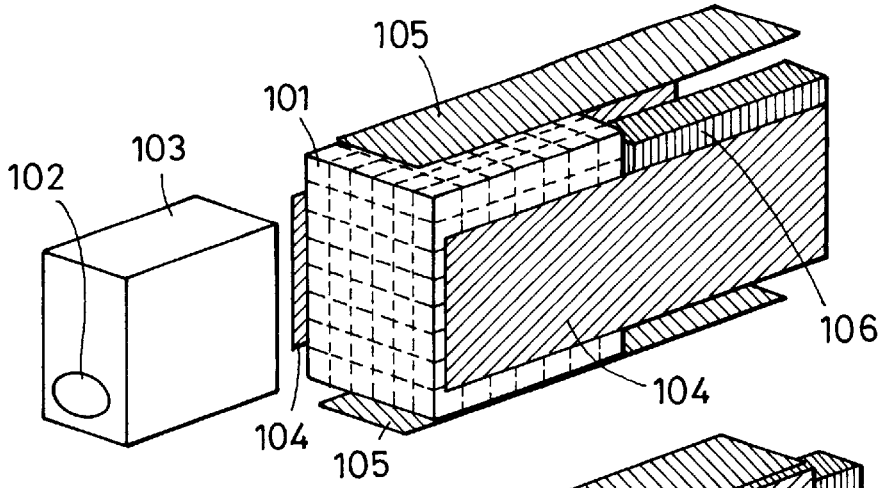
FIGS. 8A to 8D are explanatory views showing a step of inserting an ink absorber in the ink tank.
Figure 8B:
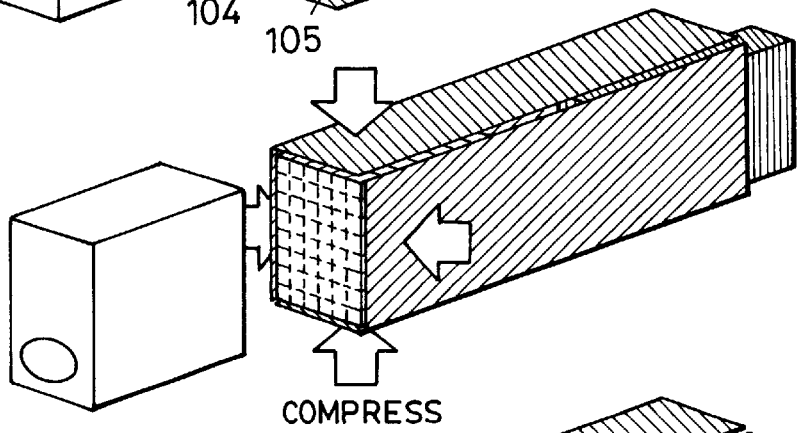
Figure 8C:
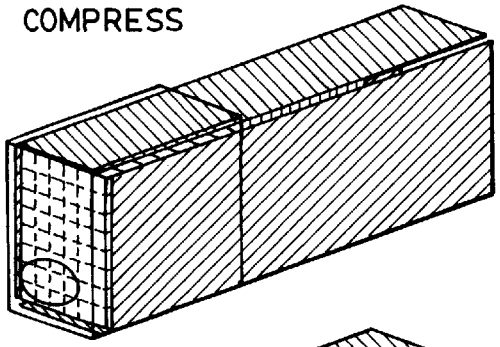
Figure 8D:
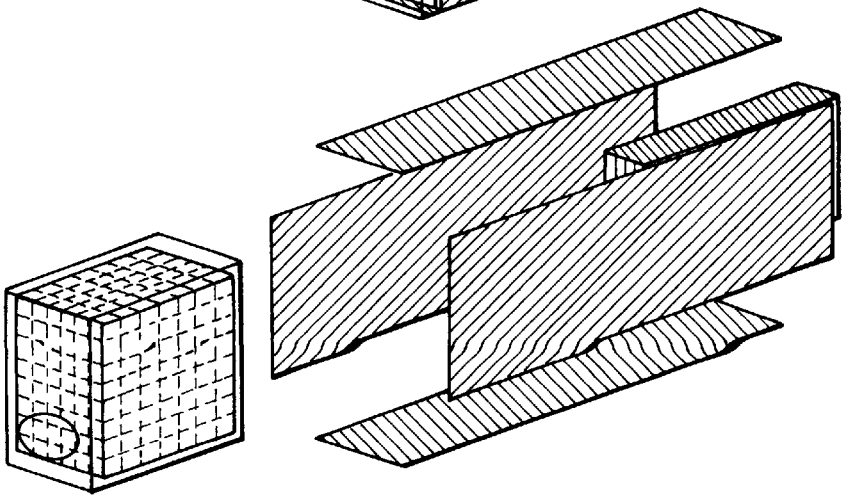

Starting from the positional relationship shown in FIG. 8A, the ink absorber 101 is compressed by the first and second pressing members 104, 105 into a compact form smaller than the inner dimensions of the ink tank molding 103 as shown in FIG. 8B. Then, as shown in FIG. 8C, the ink absorber 101 is inserted in the ink tank molding 103 along with the pressing members 104, 105. After that, the ink tank molding 103 is withdrawn while the ink absorber 101 is pushed by the third pressing member 106, whereby the ink absorber 101 is inserted in the ink tank molding 103. On that occasion, by regulating a pushing speed of the third pressing member 106 and a withdrawing speed of the ink tank molding 103, the ink absorber 101 can be inserted in the ink tank molding 103 in such a manner that a desired coarse/dense distribution is given to the ink absorber 101.

Further, as shown in FIGS. 7B and 7C, pear-skin treatment is applied, as indicated by 26, to the inner wall of the ink tank so as to provide surface roughness of 0.1 $\mu$m to 0.5 $\mu$m in terms of center line mean roughness (Ra) (JIS B 0601). As a result, friction between the inner wall of the ink tank and the ink absorber having a rough surface, such as a urethane foam, is increased. It is therefore possible to avoid the ink absorber from displacing relative to the inner wall of the ink tank due to a restoring force caused by elasticity of the absorber itself and an impact applied externally in the event of a drop or the like, and to prevent the satisfactory coarse/dense relation of the ink absorber from being lost.

If the surface roughness of not less than 0.5 $\mu$m is provided to the inner wall of the ink tank by the pear-skin treatment, resistance against removal of the ink tank from a mold in the tank molding process would be increased and the molding of the ink tank would be difficult to complete in a satisfactory manner. On the other hand, if the surface roughness is not more than 0.1 $\mu$m, frictional resistance between the absorber and the inner wall of the ink tank would be too small to provide an intended effect of the pear-skin treatment.

Additionally, the pear-skin treatment is preferably carried out by beads blasting. If sand blasting is used, the surface roughness of the tank inner wall would be too large and the sponge-like absorber would be easily crashed, resulting in a reduction of the contact area and hence of the frictional resistance therebetween.

The surface roughness of the tank inner wall having been subjected to the pear-skin treatment in an effective manner was measured under the following conditions by using a measuring device (Model SE-3400) made by Kosaka Laboratory Ltd. (Japan). As a result, it was found that the center line mean roughness (Ra) was in the range of 0.2 $\mu$m to 0.4 $\mu$m.

Measurement conditions: speed; 0.5 mm/s, cutoff $\lambda$c; 2.5 mm, E. length; 12.50 mm, and S. length; 2.50 mm.

As described above, by applying the pear-skin treatment to the inner surface of the tank case, satisfactory supply of the ink is ensured even in the ink tank having no ink holding member, because after inserting the negative pressure generating member in the ink tank while it is given a coarse/dense distribution suitable for stable ink supply, the coarse/dense distribution given to the negative pressure generating member can be kept with stability. Also in this embodiment, the pear-skin treatment may be applied to any part of the inner surfaces of the tank case, but is preferably applied to one of the inner surfaces which has a maximum surface area (i.e., the inner surface shown in FIG. 7B). It is more desired that the inner surface opposing to the above one surface, i.e., the surface treated into a pear-like skin, is also subjected to the pear-skin treatment.

What is claimed is:

1. An ink tank comprising a negative pressure generating member for retaining ink, a case for accommodating said negative pressure generating member, said case having an atmospheric opening for communicating atmosphere with an inside of said case, said case further including an ink supply portion through which the ink is led out to an exterior area, and an ink holding member having a substantially columnar shape in the ink supply portion and developing a higher capillary action than that of said negative pressure generating member, wherein:

said case includes a supply-side wall, in which the ink supply portion is disposed, and a pair of oppositely-faced side walls adjacent the supply-side wall, with inner surfaces of said pair of oppositely-faced side walls having a flat portion adjacent said ink supply portion;

a recess is formed in the flat portion of the inner surface of each of said pair of oppositely-faced side walls of said case, the recesses being opposite each other and extending in a direction from said ink supply portion toward a wall opposite the supply-side wall, each recess having a curved surface corresponding to a shape of said ink holding member; and said negative pressure generating member is held in contact with an entirety of the curved surfaces of said recesses with a compression rate of parts of said negative pressure generating member, which are positioned close to the recesses, being lower than that of parts between said flat portions.

2. An ink tank according to claim 1, wherein said ink holding member has a major diameter greater than a distance between the pair of oppositely-facing side walls.

3. An ink tank according to claim 1, wherein a part of inner surfaces of said case for accomodating said negative pressure generating member is roughened with a pear-skin treatment.

4. An ink tank according to claim 3, wherein the inner surfaces of said case roughened by the pear-skin treatment have a surface roughness of 0.1 $\mu$m to 0.5 $\mu$m in terms of a center-line mean roughness.

5. An ink tank according to claim 1, wherein said ink tank comprises a negative pressure generating member accomodating chamber, which includes the ink supply portion, said ink holding member, said atmospheric opening, and said negative pressure generating member; and an ink containing chamber containing the ink and forming a substantially enclosed space except for communication with said negative member accomodating chamber.

* * * * *

UNITED STATES PATENT AND TRADEMARK OFFICE

CERTIFICATE OF CORRECTION

PATENT NO. : 6,293,663 B1
DATED : September 25, 2001
INVENTOR(S) : Hiroshi Koshikawa et al.

It is certified that error appears in the above-identified patent and that said Letters Patent is hereby corrected as shown below:

Title page,
Under "Foreign Application Priority Data", add the following additional priority document: -- Oct. 27, 1998 (JP) .... 10-306141 --.

Column 1,
Line 21, change "type writers" to -- typewriters --.

Column 3,
Line 52, change "care" to -- are --.

Column 4,
Line 28, change "avoided" to -- prevented --.

Column 5,
Line 29, change "shown" to -- shown in --.

Column 7,
Line 37, change "of," to -- of -- and change "example" to -- example of --; and
Line 40, change "bundled" to -- bundling --.

Column 8,
Line 7, change "avoid" to -- prevent --;
Line 26, change "crashed," to -- crushed --;
Line 40, change "in the" to -- in the case of the --; and
Line 61, change "in" to -- disposed in --.

UNITED STATES PATENT AND TRADEMARK OFFICE

CERTIFICATE OF CORRECTION

PATENT NO. : 6,293,663 B1
DATED : September 25, 2001
INVENTOR(S) : Hiroshi Koshikawa et al.

It is certified that error appears in the above-identified patent and that said Letters Patent is hereby corrected as shown below:

Column 10,
Line 10, change "accomo-" to -- accommo- --; and
Line 17, change "accomodating" to -- accommodating --.

Signed and Sealed this

Twelfth Day of March, 2002

*Attest:*

*Attesting Officer*

JAMES E. ROGAN
*Director of the United States Patent and Trademark Office*